US005085207A

United States Patent [19]

Fiore

[11] Patent Number: 5,085,207

[45] Date of Patent: Feb. 4, 1992

[54] DEVICE FOR DEEP MASSAGE AND METHOD OF USING

[76] Inventor: Russell D. Fiore, 9 Raymond St., Lincoln, R.I. 02865

[21] Appl. No.: 646,287

[22] Filed: Jan. 28, 1991

[51] Int. Cl.[5] ..... A61H 1/00

[52] U.S. Cl. ..... 128/32; 128/36; 128/44; 128/52; 128/61; 128/62 R

[58] Field of Search ..... 128/24.2, 32–36, 128/41, 44, 45, 46, 48, 49, 51, 52, 59–62 R

[56] References Cited

U.S. PATENT DOCUMENTS 2,122,556 7/1938 Buffalow ..... 128/49
2,156,839 5/1939 Buffalow ..... 128/49
3,993,052 11/1976 Miyahara ..... 128/46
4,964,398 10/1990 Jones ..... 128/51

*Primary Examiner*—Robert A. Hafer
*Assistant Examiner*—Brian E. Hanlon
*Attorney, Agent, or Firm*—Robert J. Doherty

[57] ABSTRACT

An easily hand held and manipulable massaging device for achieving the effects of deep friction massage without tiring the operator. The unit includes a manipulator finger which is powered in a back and forth transverse motion and which is disposed between a stabilizing assembly preferably in the form of a pair of resiliently mounted fingers which contact the patient's skin in spaced points aligned with the transverse motion imparted by the manipulator finger to the patient's skin.

9 Claims, 3 Drawing Sheets

DEVICE FOR DEEP MASSAGE AND METHOD OF USING

BACKGROUND AND OBJECTS OF THE INVENTION

This application relates to a massaging device and particularly to a device intended for the deep friction massage of selective portions of the human body primarily in order to maintain the mobility within the soft tissue structures such as ligament, tendon and muscle and prevent adherent scars from forming or to reduce scar tissue once formed. In addition, the invention is directed to the method of utilizing such device for its intended purpose.

The advantages of deep friction massage are known and documented—for instance, Chapters 2 through 4 of the Textbook of *Orthopaedic Medicine* by James Cyriax published by Bailliere Tindall and the *Journal of Orthopaedic and Sports Physical Therapy* (Summer 1982 in an article entitled "Cyriax's Friction Massage: A Review" by Gail J. Chamberlain). Although such techniques and their attendant advantages are relatively well known, they require a high degree of physical strength and stamina for the therapist, trainer or the like to properly administer; and, accordingly, a time limited number of patients can be treated using such techniques. Also, the techniques physically tire the therapist so much that he or she may be prone to injury or attendant difficulties such as arthritis and the like. Thus, the practice is utilized sparingly or unfortunately incorrectly such that the desired results are often not obtained.

Many existent devices have been made or proposed to generally supply friction massage to patients, however, none are specifically directed to the needed deep massage techniques of the present invention nor would be fully adaptable to such. In addition although these devices and concepts present useful general techniques, there is still needed a device specifically geared to the aspects of deep friction massage which can be easily and conveniently hand held and manipulated to achieve the goals of such techniques in a simple and straightforward manner. The devices and techniques of a general nature referred to immediately above are set forth in the following U.S. patents: U.S. Pat. No. 2,714,381 to Corley et al issued Aug. 2, 1955; U.S. Pat. No. 4,249,534 to Muldrow, Jr. issued Feb. 10, 1981; U.S. Pat. No. 4,565,189 to Mabuchi issued Jan. 21, 1986; U.S. Pat. No. 4,733,655 to Smal issued Mar. 29, 1988; U.S. Pat. No. 4,777,945 to Curtaz et al issued Oct. 18, 1988; U.S. Pat. No. 4,785,798 to Yamasaki issued Nov. 22, 1988; U.S. Pat. No. 4,834,075 to Guo et al issued May 30, 1989; and U.S. Pat. No. 4,841,955 to Evans et al issued June 27, 1989.

Accordingly, an object of the present invention is to supply a device which enables the proper deep massage techniques to be applied consistently and for the necessary time periods without physically exhausting or injuring the therapist and which device ensures that the therapist may correctly apply the techniques of deep friction massage to their fullest extent.

These and other objects of the present invention are accomplished by a device for the deep frictional massage of small concentrated areas of the human patient's soft tissue below skin areas thereof such as tendons and the like comprising, a body having opposed ends with holding means at one end thereof whereby the device can be held and operated by a human operator and massaging means mounted on the other end thereof, said massaging means including a manipulator finger adapted to contact and penetrate into the skin of said human patient at a central point of contact and move in a reciprocating back and forth linear stroke motion relative to said body and stabilizing means for holding the position of said massaging means relative to the skin of said patient, said stabilizing means including resiliently mounted holding means for contacting the patient's skin at at least two generally opposed points disposed radially outward of said center point of contact of said finger with said skin and means for controlling the stroke speed of said manipulator finger.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE INVENTION

Figure 1:
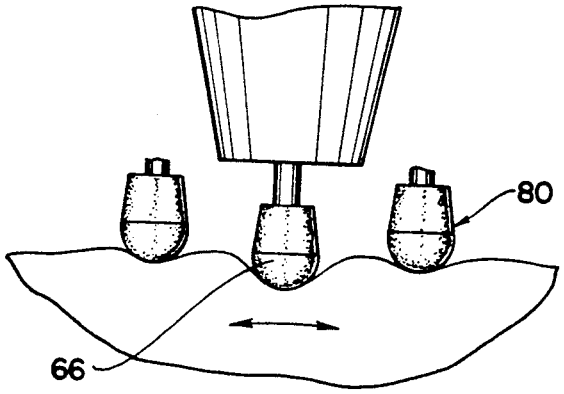
FIG. 1 is a partial enlarged view of a portion of the device of the present invention in operational contact with the skin of a patient being treated.
Figure 2A:
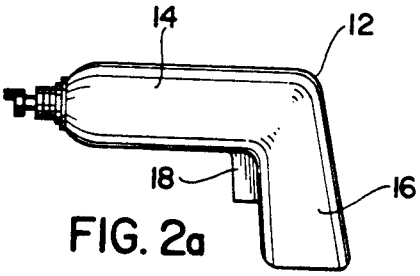
FIG. 2*a* is a side sectional view of a portion of the device showing particularly that portion thereof which is hand held by the therapist.
Figure 2:
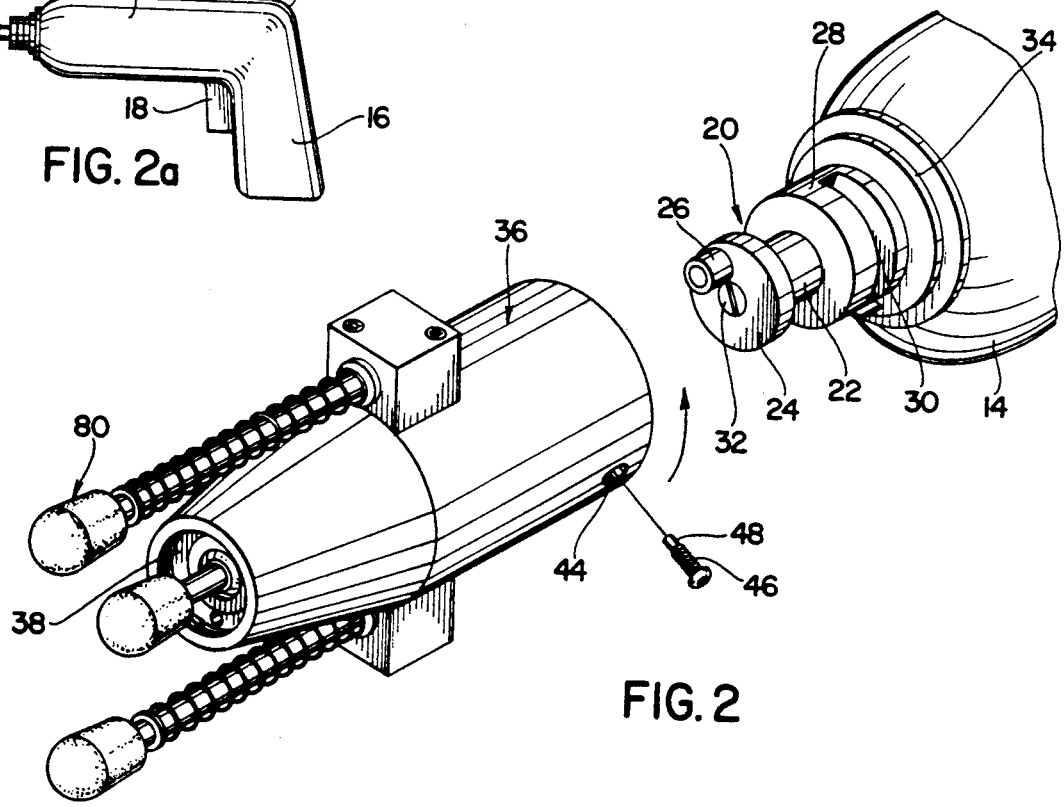
FIG. 2 is a perspective view of the forward portions of the device of the present invention partially exploded for clarity.
Figure 3:
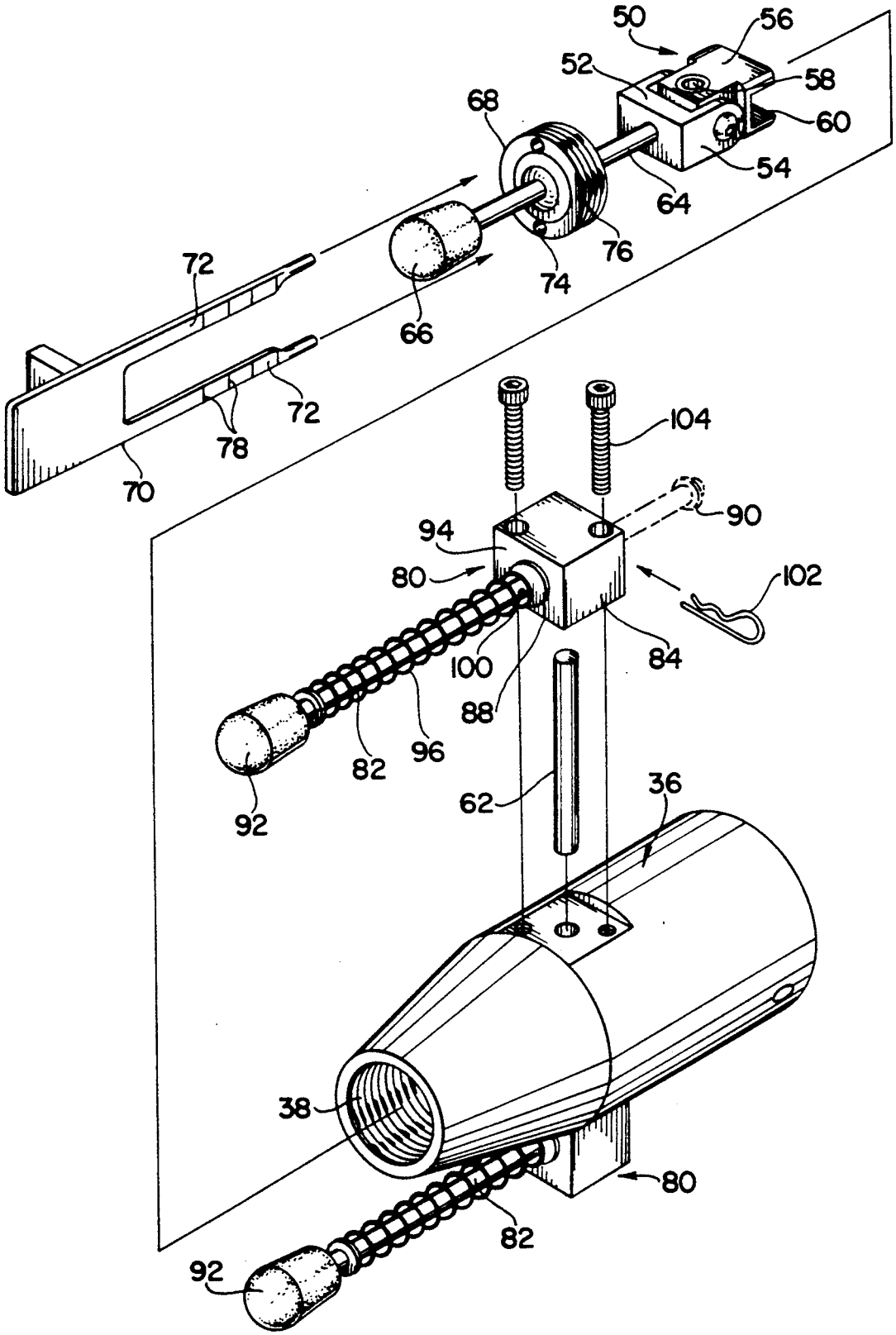
FIG. 3 is a perspective exploded view of the forward housing portion of the device showing the manner in which the various components thereof are assembled and operated.

Turning now to the drawings and particularly FIGS. 2 and 2*a* thereof, the invention in its present preferred form is illustrated as a massage housing mounted to the forward end of a drive unit in the form of a battery operated electric drill. Naturally, a dedicated device could be utilized or one which utilizes commercial alternating current electricity (cord source). Accordingly, the device 10 of the present invention includes a hand held unit 12 including a central case 14 in which a conventional drive mechanism is supported and a downwardly extending handle portion 16 for aid in grasping the unit by the therapist and as a storage for batteries and the like used to power the drive unit 12. A trigger 18 functions to turn the unit off and on and regulate its speed.

At the forward end of the unit and as best shown to the right in the FIG. 2 is a modified chuck assembly 20 including a driveshaft 22 adapted to be rotationally powered by the drive unit 12. The driveshaft in turn terminates in a disc 24 provided with an eccentrically disposed driving cam 26. In addition, that portion of the driveshaft distal from the disc 24 includes an enlarged cylindrical boss 28 provided with at least one arcuate recess 30 which defines a segment of at least 90 degrees for a purpose which will hereinafter be apparent. The above described modified chuck assembly may be attached directly to the rotating spindle of a conventional drive unit 12 through bolt 32 or other known means. In addition, the forward end of the drive unit includes a circumferential shelf 34 on which rear portions of a forward housing 36 are adapted to be supported.

The forward housing is best shown by simultaneous reference to FIGS. 2 through 5 and includes open front and rear ends 38, 40 respectively. The rear end 40 in turn includes a stepped circular shelf 42 adapted to rest on the shelf or ledge 34 to provide a snug fit between the joined members, namely, the housing 36 and the drive unit 12 forward end, but which enables the housing to be at least partially rotated with respect thereto by a firm turning motion of the housing vis-a-vis the drive unit by the therapist. The housing is further provided with a threaded opening 44 for receipt of a partially threaded bolt 46 which extends through the housing body and is provided with an unthreaded portion 48 which extends into the slot 30 and in frictional contact therewith such that the housing may not be longitudinally separated from the drive unit but may be forcefully twisted to overcome the frictional force by which it is mounted thereon to various rotationally positioned attitudes with respect thereto.

Figure 4:
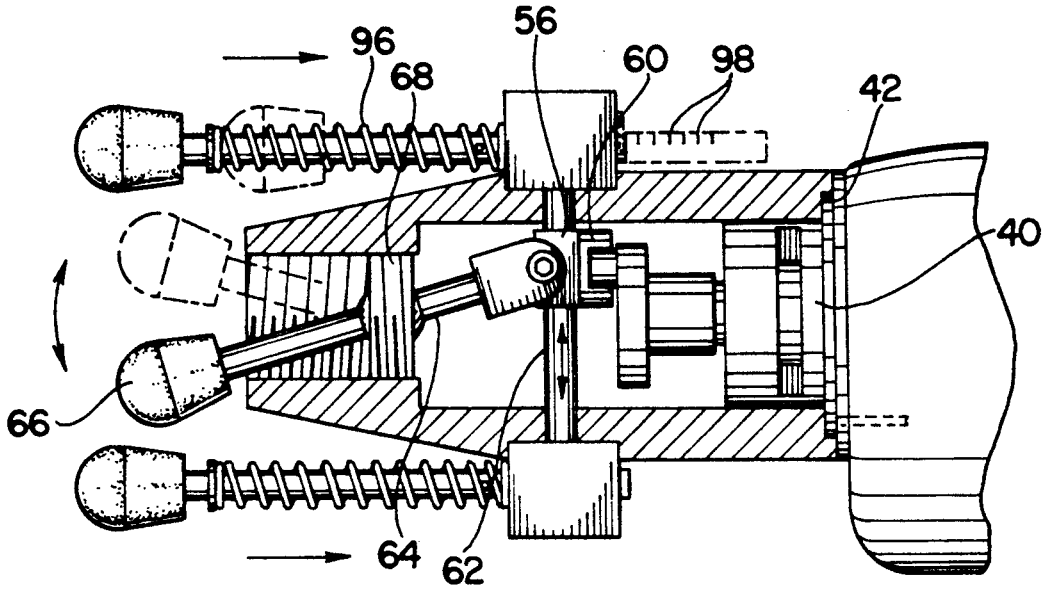
FIG. 4 is a side sectional view of the housing showing the manner in which such operates.
Figure 5:
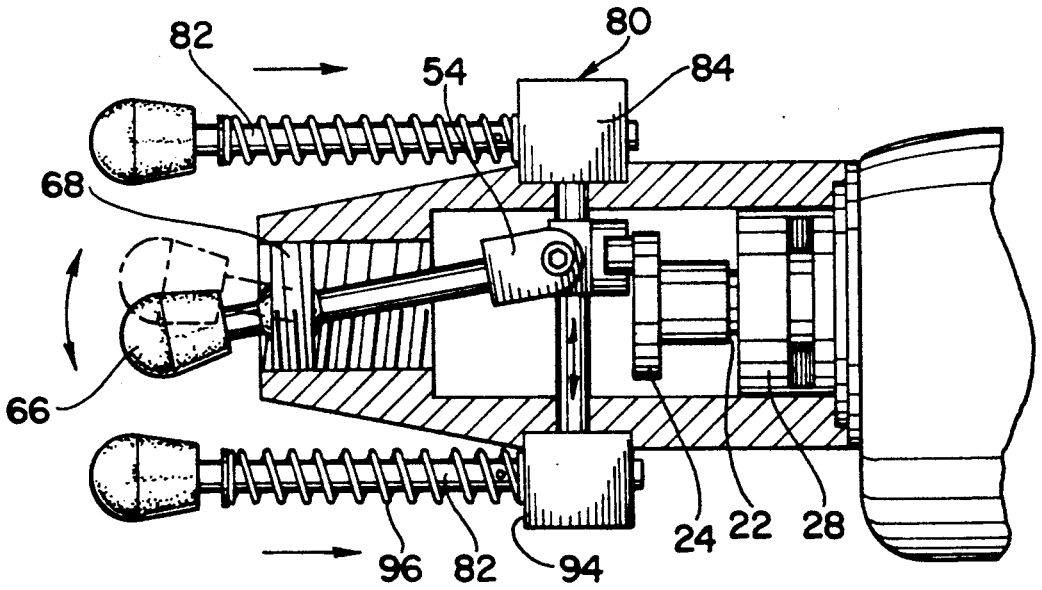
FIG. 5 is a view similar to FIG. 4 but showing an alternate position thereof adjusted for a shorter stroke of the manipulator finger.

As best shown in FIGS. 4 and 5, the chuck assembly 20 extends inside the housing 36 which in turn is provided with a drive connection means including a rotary to longitudinal motion link which in turn is coupled to the drive unit via the cam 26. The link 50 includes a forward pivot member having a pair of arms 54 rearwardly extending and in turn attached to a slide 56. The slide 56 includes a forward portion through which a bore 58 transversely extends and a rear slotted portion 60 into which the drive cam 26 extends. The bore 58 is provided with bearing surfaces as is the drive cam 26 and the link 50 mounted internally of the housing 36 with a pin 62 transversely passing through the housing body and the bore 58 such that the link 50 slides back and forth in a transverse direction upon the pin 62 while the drive cam 26 rotates in a circular path.

In addition, the forward pivot member 52 supports a manipulator finger 64 which extends longitudinally therefrom through the forward part of the housing and outwardly thereof. The fingers preferably capped by a cot 66 formed of rubber and the like to provide a frictional co-action between the device 10 and the skin of the patient being manipulated. The outer terminal surface of the finger 64 whether formed by a cot or not is preferably replaceable for sanitary considerations as well as providing some measure of friction vis-a-vis the skin that, of course, can be varied by changing the cot or the like.

The housing forward part is internally threaded and provided with a fulcrum or bearing ring 68 through which the shaft of the finger 64 extends. Additionally, the ring is provided at its outer radial surfaces with threads such that it may be longitudinally threaded to various positions back and forth along the threaded extent of the housing forward portion. In this manner, the manipulator finger amplitude may be regulated depending on the cross sectional area of the tissue being treated. Thus by looking at the various bearing ring 68 positions in FIGS. 4 and 5, it will be apparent that a position more rearwardly disposed within the housing 36 threaded portion achieves the highest amplitude, that is, the greatest amount of transverse movement against the patient's skin, while the forwardmost position of the bearing ring 68, as shown in FIG. 5, produces the least amount of transverse movement of the free end of the manipulator finger. A forked implement 70 having a pair of transversely separated tines 72 is adapted to be extended into the housing 36 open front end for contact with a pair of openings 74 in the front face 76 of the ring 68 so that rotation thereof effects the transverse movement of the ring vis-a-vis the housing. In order to determine the ring position vis-a-vis the housing and, accordingly, the amplitude that will be provided to the free end of the manipulator finger, the tines 72 may be provided with depth lines 78 or other measurements such that a consistent relative amplitude may be achieved.

The housing 36 forward end is further provided with stabilizing means 80. The stabilizing means 80 includes a pair of resiliently mounted pins 82 or shafts longitudinally disposed on opposite sides of the housing by mounting blocks 84. The blocks 84 are in turn adapted to fit within appropriate flats 86 provided on opposite sides of the housing. The pins 82 extend longitudinally through a longitudinal bore 88 provided in the blocks 84 and are prevented from accidental removal therefrom by a lock washer assembly 90 at the rear ends thereof and a resilient cot 92 similar to finger cots 66 on the other end thereof. Intermediate the forward face 94 of the blocks and the cots 92 is a coil spring 96 which serves to resiliently forwardly urge the pins 82 and, accordingly, its cot 92 into contact with the patient's skin. The position of this contact is in transversely opposed points in line with the finger cot 66 when the device is in operable position. Preferably the cots 92 of the resilient stabilizing 80 means engage the patient's skin slightly before the manipulator finger to provide a firm and stabilizing contact between the device 10 and the patient's skin such that the repeated manipulator finger transverse movement across and into the patient's skin will provide the required deep massage without, in effect, losing one's place, that is, the transverse movement of the terminal surface of finger 64 on the patient's body.

The amount of force applied by the resilient stabilizing means is dependent upon the spring force of the spring 96, the contact area of the cot 92, and other determinants that can be arrived at by trial and error and experience. Furthermore by providing indicia marks 98 on the rear of one or both of the shafts 82, the extent to which the shafts are forced upwardly through the blocks 84 and thus the extent to which the manipulator finger extends into the patient's skin depending on the depth of fat or other soft tissue directly above the specific area being treated can be visually observed by the therapist. Similarly, indicia (not shown) could be placed on the housing body to measure such rearward movement of the stabilizing means pins.

In some cases, it may be desirable to function without one or both of the stabilizing pins and in that regard, the pins are provided with a hole 100 in a portion thereof that is normally disposed slightly forward of the forward face 94 of the block and which in turn may be resiliently rearwardly forced to the block 84 rear face and held in such position by a cotter pin 102 or other known holding devices. In this regard, it should also be pointed out that the blocks 84 are held to the flats 86 and thus the housing 36 with threaded bolts 104 or other known means.

In utilizing the device 10 as above described, the operator therapist places the housing forward end such that the cots 92 transversely span the longitudinal extent of the muscle, tendon, etc. that is to be manipulated and thereafter the desired downward force provided by the operator and simultaneous activation of the manipulator finger such that its outer surface 66 moves firmly and positively relative to the patient in a repeated and non-exhaustive motion so long as the comfortable holding position of the device 10 by the therapist is continued. This enables the therapist to provide the needed depth and forceful massage that is required to achieve the results of the deep friction massage techniques as well as a direct feel or feed back from the essentially non-retractable finger since the device is hand held. Also, it should be pointed out to achieve the proper orientation of the housing vis-a-vis the patient since a comfortable holding position of the drive unit does not always transversely align itself to the tendon or muscle group being worked upon, the housing is rotatably movable vis-a-vis the drive unit through its frictional mounting thereon because of the shelf and slot 34 and 30 respectively as previously brought out.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A device for the deep frictional massage of small concentrated areas of the human patient's body below skin areas thereof such as tendons and the like comprising, a body having opposed ends with holding means at one end thereof whereby the device can be held and operated by a human operator and massaging means mounted on the other end thereof, said massaging means including a manipulator finger adapted to contact and penetrate into the skin of said human patient at a central point of contact and move in a reciprocating back and forth linear stroke motion relative to said body so as to provide for pinpoint localized massage and stabilizing means for holding the position of said massaging means relative to the skin of said patient, said stabilizing means including holding means comprising at least one member mounted for continual forward urging for contacting the patient's skin at at least one point disposed radially outward of said center point of contact of said finger with said skin and means for controlling the stroke speed of said manipulator finger, said finger mounted for movement independent of said stabilizing means and said stabilizing means resiliently retractable for regulating the depth of skin penetration of said finger.

2. The device of claim 1 including means for regulating the length of the finger stroke.

3. The device of claim 1, said body having a forward end to which a housing is attached, said housing having open rear and front ends, said body including a motor for driving a drive head in turn projecting forwarding of said body forward end and into said housing open rear end, said manipulator finger including a shaft having inner and outer ends positioned in said housing open front end and drive connection means in said housing in turn connecting said drive means to said shaft, said shaft outer end projecting outwardly of said housing front end and terminating in a removable friction head.

4. The device of claim 3, said drive head being rotatable and said drive connection means including a rotary to longitudinal motion link.

5. The device of claim 4, said finger shaft having a bearing ring longitudinally movable therealong, and forming a transverse motion pivot therefor, said ring threadably mounted to said housing front end whereby rotation of said bearing ring changes the pivot point of said shaft and thereby the stroke of said reciprocal finger motion.

6. A device for the deep frictional massage of small concentrated areas of the human patient's body below skin areas thereof such as tendons and the like comprising, a body having opposed ends with holding means at one end thereof whereby the device can be held and operated by a human operator and massaging means mounted on the other end thereof, said massaging means including a manipulator finger adapted to contact and penetrate into the skin of said human patient at a central point of contact and move in a reciprocating back and forth linear stroke motion relative to said body and stabilizing means for holding the position of said massaging means relative to the skin of said patient, said stabilizing means including resiliently mounted holding means for contacting the patient's skin at at least two generally opposed points disposed radially outward of said center point of contact of said finger with said skin and means for controlling the stroke speed of said manipulator finger, said body having a forward end to which a housing is attached, said housing having open rear and front ends, said body including a motor for driving a drive head in turn projecting forwarding of said body forward end and into said housing open rear end, said manipulator finger including a shaft having inner and outer ends positioned in said housing open front end and drive connection means in said housing in turn connecting said drive means to said shaft, said shaft outer end projecting outwardly of said housing front end and terminating in a removable friction head, said stabilizing means holding means including a pair of pins mounted at the forward end of said housing, said pins being resiliently forwardly urged and rearwardly retractable and terminating at forward ends thereof in a removable friction head for firmly contacting the patient's skin.

7. The device of claim 6 said housing mounted on said body for limited relative rotational positioning with respect thereto.

8. The device of claim 6 including means for positing at least one of said pins in a retracted non-operational position.

9. The method of frictionally massaging a soft tissue group of a human patient with the massage device of claim 1 including positioning the device such that both the stabilizing means and the manipulator finger firmly contact the patient's skin above said tendon, positioning and activating the finger such that the linear stroke thereof is generally transverse the general longitudinal extent of said soft tissue group and applying sufficient downward pressure on said device such that said finger repeatedly contacts said tendon group during its reciprocal motion and the stabilizing means continually contacts said patient's skin independently of the movement of said finger.

* * * * *